US005325546A

United States Patent [19]

Setliff

[11] Patent Number: 5,325,546

[45] Date of Patent: Jul. 5, 1994

[54] HAND HELD SPITTOON

[76] Inventor: Norman B. Setliff, Rte. 1, Box 40c, Coolridge, W. Va. 25825

[21] Appl. No.: 57,862

[22] Filed: May 7, 1993

[51] Int. Cl.[5] ..... A61J 19/00

[52] U.S. Cl. ..... 4/267; 4/258; 4/274; 4/283; 4/285

[58] Field of Search ..... 4/258, 259, 266, 267, 4/271, 274, 276, 279, 281, 283, 284, 285; 126/32

[56] References Cited

U.S. PATENT DOCUMENTS

| | | | |
|---|---|---|---|
| 208,392 | 9/1878 | Holden . | |
| 709,165 | 9/1902 | Lindsay | 4/258 |
| 735,043 | 7/1903 | Tobin . | |
| 965,109 | 7/1910 | Horvath et al. | 4/283 |
| 1,019,565 | 3/1912 | Walent | 4/283 |
| 1,301,249 | 4/1919 | Gough et al. | 4/281 |
| 2,503,045 | 4/1950 | Hamilton . | |
| 4,503,572 | 3/1985 | Dawson . | |

FOREIGN PATENT DOCUMENTS

| | | | |
|---|---|---|---|
| 12611 | of 1890 | United Kingdom | 4/267 |

*Primary Examiner*—Henry J. Recla
*Assistant Examiner*—Charles R. Eloshway
*Attorney, Agent, or Firm*—Richard C. Litman

[57] ABSTRACT

A spittoon comprising a receptacle and a sleeve. The receptacle includes a handle intended to be grasped by a user when transporting the same. The receptacle matingly engages the sleeve to form a seal therebetween. The sleeve is disposed substantially interiorly of the receptacle and comprises a drain hole and a drain plug received by the drain hole. The drain hole is located in a sidewall of the sleeve adjacent the open upper end thereof so as to permit the contents within the receptacle to be drained from the receptacle. The drain plug is removably received by the drain hole to block the drain hole and prevent the contents of the receptacle from passing therethrough. The sleeve is configured to provide a restrictive passage for spittle or saliva to enter into the receptacle and to form a liquid trap to resist spilling of the same from the receptacle. A cover is releasably attachable to the receptacle to seal the receptacle to prevent the contents therein from escaping therefrom.

9 Claims, 3 Drawing Sheets

HAND HELD SPITTOON

BACKGROUND OF THE INVENTION

1. Field of the Invention

The present invention relates to spittoons and more particularly, to a spittoon having a liquid trap.

2. Description of the Prior Art

Chewing tobacco has regained widespread popularity, especially in rural areas. Those who indulge in chewing tobacco often will use as a spittoon whatever may be at their disposal. For instance, one might use a disposable cup, such as a coffee cup, or an empty beverage container, such as an empty juice bottle or a soft drink can. It is not uncommon for someone to inadvertently drink from such an article. This is truly an unpleasant mistake. Alternatively, a piece of everyday ware, such as kitchen cup or a glass may be employed. Often the article is carried throughout the travels of the user. It may be carried away from the home at the risk of being forgotten. Losing kitchenware could be costly. Moreover, these items are generally part of a set and the loss of the item renders the set incomplete. If an individual is enjoying a chew of tobacco while driving, a makeshift spittoon could overturn and its contents spill creating an unsightly mess. Several spittoons have been devised which are the subject of a number of patents. One spittoon, for example, is a pocket spittoon and is disclosed in U.S. Pat. No. 208,392, issued Sep. 24, 1878, to Magdalene Holden. Holden's spittoon has a body with a concave cap threadably attached thereto. A hole is provided in the bottom of the concave cap which permits saliva to enter into the body. The hole may be selectively open and closed by a slide turned by a spindle. The cap is concave to reduce the risk of saliva from escaping from the spittoon should the spittoon become inverted. A cover is threadably attachable to the concave cap to seal the spittoon when not in use. Unlike Holden, applicant's instant invention includes a sleeve having a drain hole and a removable drain plug received by the drain hole. Further, applicant's invention includes a cover which is attachable to the receptacle via a matingly engageable lip and groove arrangement.

Another spittoon is shown in U.S. Pat. No. 735,043, issued Jul. 28, 1903, to John Tobin. Tobin describes a spittoon which may be carried in a shirt pocket. The spittoon comprises a casing provided with a hinged lid together with devices for holding the lid in a closed position and other devices for throwing the same in an open position on release thereof. Located within the spittoon is a removable receiver for spittle intended to be destroyed along with its contents after use. The receiver has a sunken top portion having a mouth therein configured to prevent content spillage if the spittoon is inadvertantly overturned. A novel feature of applicant's instant invention lies in the incorporation of the sleeve having the drain hole and plug as well as the manner in which the lid is attached to the receptacle.

A spittoon cup is shown in U.S. Pat. No. 2,503,045, issued Apr. 4, 1950, to Kenneth C. Hamilton. Hamilton discloses an open receptacle having a groove in the sidewall thereof adjacent the opening thereof. A frustoconical shaped baffle member is seated on the receptacle side wall groove to prevent leakage of liquid between the baffle and the receptacle groove, if the device is accidentally overturned. Similar to that disclosed by Holden and Tobin above, the baffle shown in the Hamilton patent is configured to prevent spillage in the event that the receptacle is overturned. Optionally, a cover may be employed to cover the opening of the receptacle when not in use. Hamilton does not show or describe a sleeve having a drain hole and plug as is included in applicant's invention. Further, the cooperative engagement of the sleeve and the receptacle is unlike that disclosed by Hamilton.

Patricia S. Dawson discloses a disposable receptacle for spittle in U.S. Pat. No. 4,503,572, issued Mar. 12, 1985. Dawson describes a receptacle having a top and a base. A lid having and aperture of a selected diameter therethrough is attached by a channel member to a lip of the receptacle to secure the lid to the receptacle to form a water tight seal. A hollow truncated conical section which extends from the lid into the receptacle. The extension of the conical section into the receptacle minimizes spillage. Applicant's invention includes a sleeve having a drain hole and plug which is not shown in the Dawson patent.

None of the above patents, taken either singly or in combination, is seen to describe the instant invention as claimed.

SUMMARY OF THE INVENTION

The present invention relates to a spittoon comprising a receptacle and a sleeve. The receptacle includes a handle intended to be grasped by a user when transporting the same. The receptacle matingly engages the sleeve to form a seal therebetween. The sleeve is disposed substantially interiorly of the receptacle. The sleeve comprises a drain hole and a drain plug received by the drain hole. The drain hole is located in a sidewall of the sleeve adjacent the open upper end thereof. The drain hole permits the contents within the receptacle to be drained therefrom. The drain plug is received by the drain hole to block the drain hole and prevent the contents of the receptacle from passing therethrough. The drain plug may be easily snapped into and pried out of the drain hole. The sleeve is configured to provide a restrictive passage into the receptacle and to form a liquid trap to resist spilling of the contents from the receptacle. The spittoon further includes a cover releasably attachable to the receptacle to seal the receptacle to prevent the contents therein from escaping therefrom.

Accordingly, it is a principal object of the invention to provide a spittoon comprising a receptacle having a handle for transporting the same and a sleeve matingly engaging the receptacle so as to form a seal therebetween.

It is another object that the sleeve be disposed substantially interiorly of the receptacle and be comprised of a drain hole and a drain plug received by the drain hole whereby the drain hole permits the contents within the receptacle to be drained therefrom and the drain plug blocks the drain hole to prevent the contents of the receptacle from passing therethrough.

It is a further object that the drain plug be easily snapped into and pried out of the drain hole.

Still another object is that the sleeve be configured to provide a restrictive passage into the receptacle and to form a liquid trap to resist spilling of the contents from the receptacle.

Another object is to provide a cover which is releasably attachable to the receptacle to seal the receptacle to prevent the contents therein from escaping therefrom.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
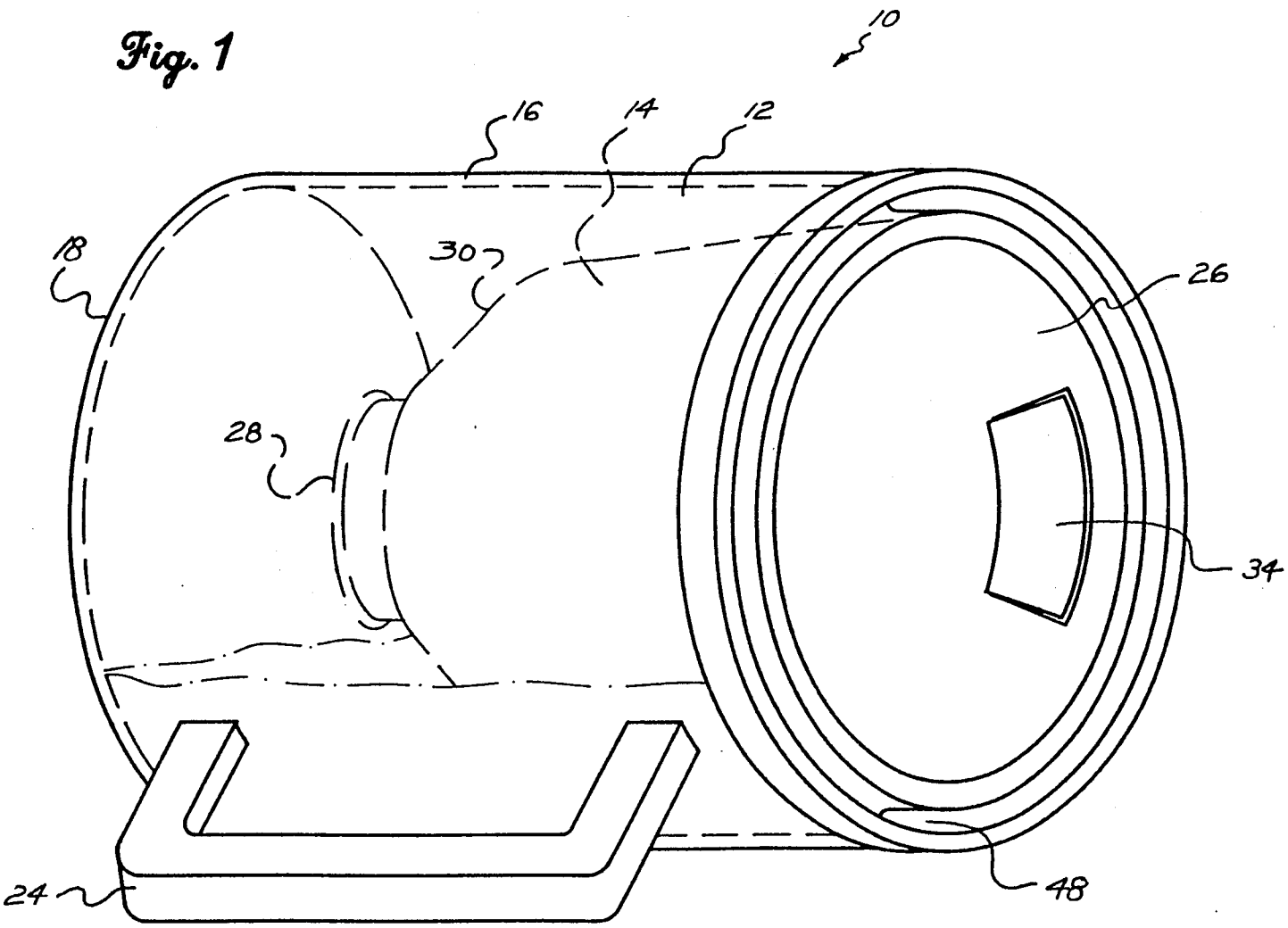
FIG. 1 is an environmental perspective view of a spittoon in accordance with the present invention.

The present invention, as shown in FIG. 1 is a spittoon 10 comprising a receptacle 12 and a sleeve 14. The receptacle 12 is shown to be substantially cylindrical in shape having a peripheral sidewall 16, a closed bottom end 18, and an open upper end 20. The receptacle 12 includes a lip 22, more clearly shown in FIG. 2, which matingly engages the sleeve 14. The receptacle 12 further includes a handle 24 integral with the sidewall 16 thereof. The handle 24 is intended to be grasped by a user (not shown) when the spittoon 10 is in transport.

The sleeve 14 is disposed interiorly of the receptacle 12. The sleeve 14 has an open upper end 26, an open lower end 28, and a peripheral sidewall 30. The sleeve 14 further comprises a drain hole 32 in the sidewall 30 and a drain plug 34 received by the drain hole 32. The open upper end 26 of the sleeve 14 is substantially equivalent or slightly larger than the open lower end 28 of the sleeve 14 to provide a restrictive passage into receptacle 12. This yields a sleeve 14 which is substantially frusto-conical in shape. The configuration of the sleeve 14 forms a liquid trap to resist spilling of saliva or spittle S contained within the receptacle 12 should the spittoon 10 become inadvertently overturned, as is shown specifically in FIG. 1.

Figure 2:
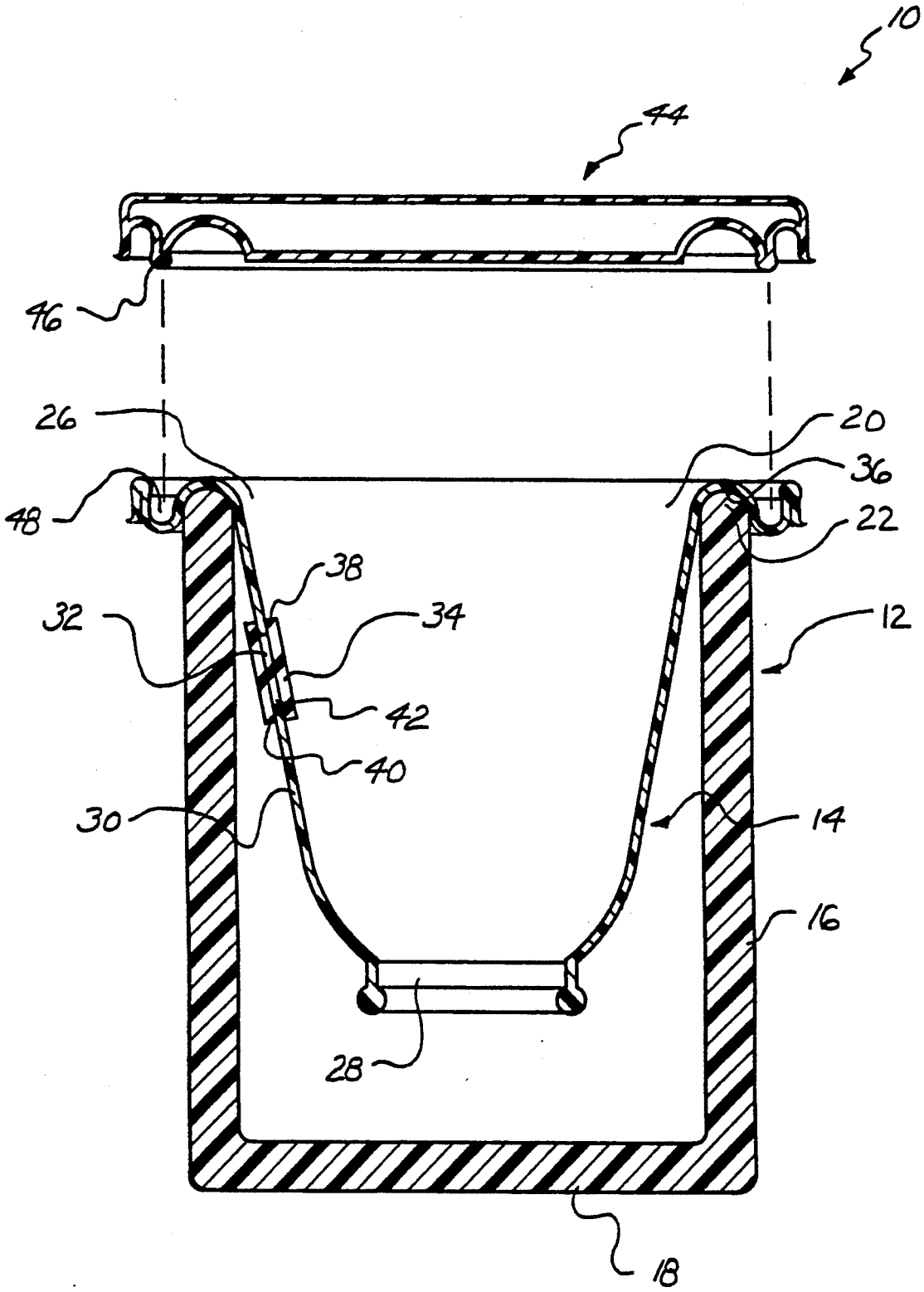
FIG. 2 is a cross-sectional view of the spittoon shown in FIG. 1.
Figure 3:
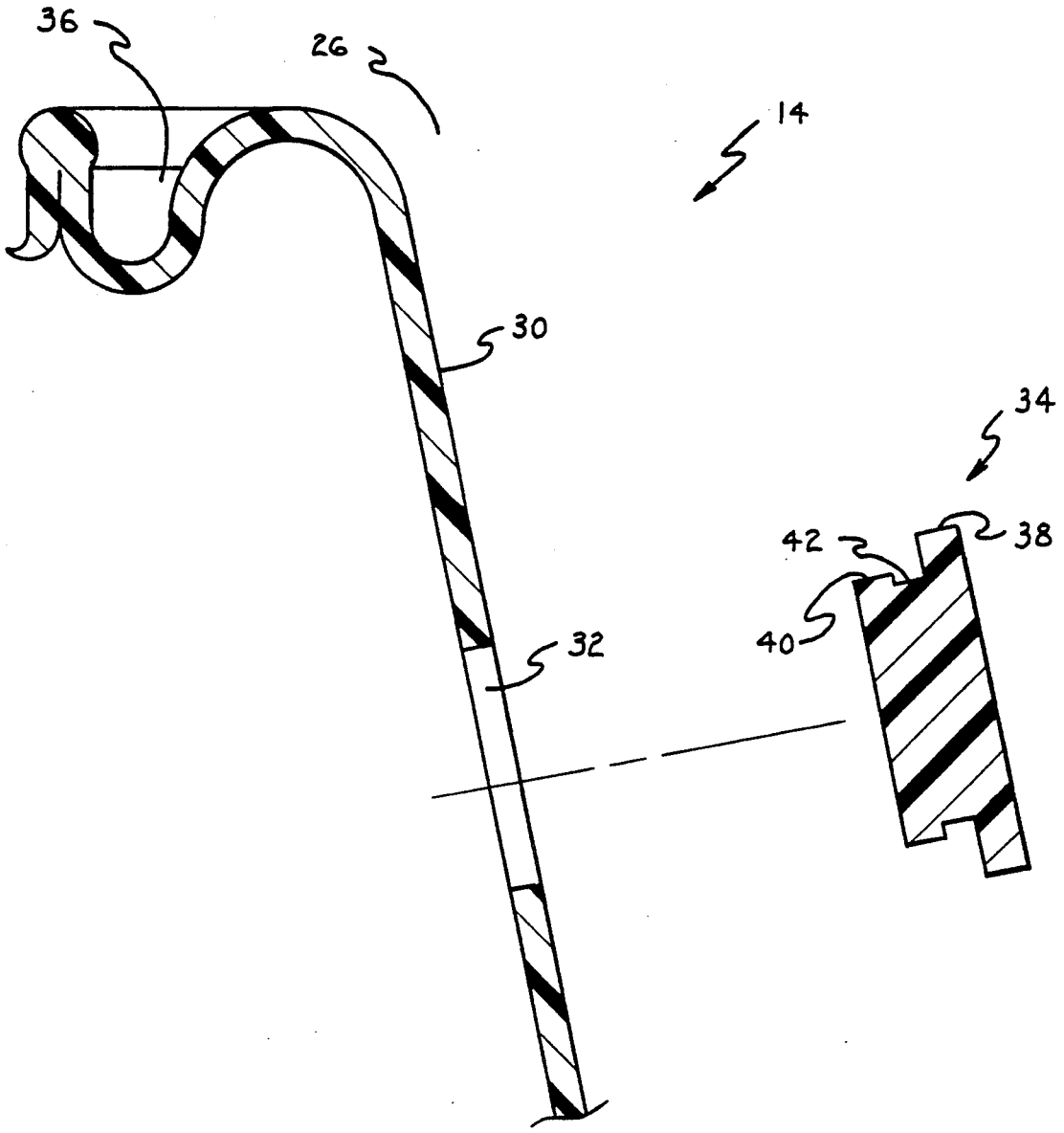
FIG. 3 is a detail view showing the removal of the drain plug from the drain hole.

As shown in FIGS. 2 and 3, the sleeve 14 includes a rib 36 disposed about the open upper end 26 thereof which is intended to receive the lip 22 of the receptacle 12, as shown more clearly in FIG. 2, so as to form a seal between the sleeve 14 and the receptacle 12. Preferably, the sleeve 14 and the receptacle 12 are joined in a permanent fashion to reduce the risk of leakage between the sleeve 14 and the receptacle 12 which may otherwise occur if the two were continuously separated and rejoined.

Referring to FIGS. 1 through 3, the drain hole 32 is located in the sidewall 30 of the sleeve 14 adjacent the open upper end 26 thereof. This permits the saliva S contained within the receptacle 12 to be drained from the receptacle 12. More complete drainage of saliva S is advanced by higher relative positioning of the drain hole 32 along the sidewall 30. Total drainage of the saliva S is achieved when the drain hole 30 is position at the apex formed by the juncture of the sidewalls 30 and 16. It is noted however that such positioning may conflict with the proper functioning of the drain plug 34 and the cover 44, both described further below.

As shown in FIGS. 2 and 3, the drain plug 34 is received by the drain hole 32 block the drain hole 32 and prevent the saliva S from passing therethrough. The drain plug 34 shown is substantially rectangular and arcuate in shape. Other shapes can be utilized in accordance with the invention. The drain plug 34 has an outer peripheral edge 38, an inner peripheral lip 40, and an annular groove 42 formed between the peripheral edge 38 and the lip 40. The inner lip 40 is slightly larger in dimension than the drain hole 32, the annular groove 42 has a dimension substantially equivalent to that of the drain hole 32, and the outer peripheral edge 38 is significantly larger than the drain hole 32. The drain plug 34 is fabricated of a resilient material which permits the lip 40 to compress upon passing through the drain hole 32 and to expand to engage the inner surface or unexposed surface of the sidewall of the sleeve 14 to retain the drain plug 34 within the drain hole 32. The outer peripheral edge 38 of the drain plug 34 restricts the travel of the drain plug 34 through the drain hole 32. The drain plug 34 is dimensioned and configured to fit tightly in the drain hole 32 to form a seal therebetween. As shown in FIG. 3, the drain plug 34 is removed from the drain hole 32. This is easily accomplished by prying against the inner surface of the outer peripheral edge 38 of the drain plug 34, that is, the unexposed surface of the outer peripheral edge 38. The lip 40 will compress and the drain plug 34 will pop out of the drain hole 32.

The spittoon 10 further includes a cover 44 releasably attachable to the receptacle 12 to seal the receptacle 12 against saliva S escaping therefrom. The periphery of the cover 44 includes an lip 46 which is matingly engageable with a rib 48 about the upper end of the sleeve 26. The rib 48 and lip 46 arrangement form a seal between the cover 44 and the sleeve 14.

It is to be understood that the present invention is not limited to the sole embodiment described above, but encompasses any and all embodiments within the scope of the following claims.

I claim:

1. A spittoon comprising:

a receptacle; and a sleeve disposed interiorly of said receptacle, said sleeve having an upper and lower end and a sidewall, said sleeve further comprising:

means defining an opening in said lower end thereof for providing a restrictive passage into said receptacle, means defining a drain hole in said sidewall thereof, and a drain plug received by said drain hole.

2. The spittoon according to claim 1, further including means for forming a seal between said sleeve and said receptacle.

3. The spittoon according to claim 1, wherein said receptacle includes an upper end and a lip about said upper end, and wherein said sleeve includes a rib disposed about said upper end thereof for receiving said lip of said receptacle and for forming a seal therebetween.

4. The spittoon according to claim 1, wherein said sleeve is configured to form a liquid trap to resist spilling upon inadvertently overturning said spittoon.

5. The spittoon according to claim 1, wherein said sleeve is frusto-conical in shape to form a liquid trap to minimize spillage from said spittoon upon inadvertently overturning said spittoon.

6. The spittoon according to claim 1, further including a handle formed integrally with said receptacle.

7. The spittoon according to claim 1, wherein said drain plug is located adjacent said upper end of said sleeve to maximize drainage of said receptacle.

8. The spittoon according to claim 1, further including a cover releasably attachable to said sleeve to seal said receptacle against contents escaping therefrom.

9. The spittoon according to claim 8, further including a rib and lip arrangement for matingly engaging said cover and said sleeve to form a seal between said cover and said sleeve.

* * * * *